US010544541B2

(12) United States Patent
Katsuki et al.

(10) Patent No.: US 10,544,541 B2
(45) Date of Patent: Jan. 28, 2020

(54) CLOTHES DRYER

(71) Applicants: QINGDAO HAIER WASHING MACHINE CO., LTD., Qingdao, Shandong (CN); AQUA CO., LTD, Chiyoda-ku, Tokyo (JP)

(72) Inventors: Jungo Katsuki, Tokyo (JP); Taichi Hayashida, Tokyo (JP); Taiki Mori, Tokyo (JP)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 203 days.

(21) Appl. No.: 15/758,681

(22) PCT Filed: Sep. 7, 2016

(86) PCT No.: PCT/CN2016/098310

§ 371 (c)(1),
(2) Date: Mar. 8, 2018

(87) PCT Pub. No.: WO2017/041712

PCT Pub. Date: Mar. 16, 2017

(65) Prior Publication Data

US 2018/0251934 A1 Sep. 6, 2018

(30) Foreign Application Priority Data

Sep. 9, 2015 (JP) ..... 2015-177362

(51) Int. Cl.
*F26B 3/00* (2006.01)
*D06F 58/28* (2006.01)

(52) U.S. Cl.
CPC ..... *D06F 58/28* (2013.01); *D06F 2058/289* (2013.01); *D06F 2058/2893* (2013.01); *D06F 2058/2896* (2013.01)

(58) Field of Classification Search
CPC ..... D06F 58/28; D06F 58/263; D06F 2058/2893; D06F 2058/2896; D06F 2058/289; D06F 2058/2829
(Continued)

(56) References Cited

U.S. PATENT DOCUMENTS 4,231,166 A 11/1980 McMillan
4,506,458 A 3/1985 Cochrane
(Continued)

FOREIGN PATENT DOCUMENTS

CN 1978731 A 6/2007
CN 101967746 A 2/2011
(Continued)

OTHER PUBLICATIONS

Extended European Search Report for corresponding European Patent Application No. 16843650.9 dated Mar. 18, 2019 (8 pages).

*Primary Examiner* — John P McCormack
(74) *Attorney, Agent, or Firm* — Arent Fox LLP

(57) ABSTRACT

Disclosed is a clothes dryer. The clothes dryer includes a drum; an air supply/exhaust unit for supplying/exhausting drying air to/from the drum; a burner for heating the drying air; a temperature sensor for detecting an exhaust temperature; and a heating control unit for performing a temperature adjustment process of stopping the burner when the exhaust temperature reaches an upper limit temperature and restarting the burner after a time point when the exhaust temperature decreases to a re-ignition temperature. The heating control unit has a delay time inserting portion, which inserts a delay time between the time when the exhaust temperature decreases to a lower limit temperature and the time when the burner is restarted. The delay time is increased every time the temperature adjustment process is repeated intermittently.

6 Claims, 4 Drawing Sheets

(58) Field of Classification Search
USPC ..... 34/486, 108
See application file for complete search history.

(56) References Cited

U.S. PATENT DOCUMENTS

| | | | | |
|---|---|---|---|---|
| 4,763,425 | A | 8/1988 | Grennan | |
| 4,991,313 | A * | 2/1991 | Joslin | D06F 58/28 34/555 |
| 2007/0186438 | A1* | 8/2007 | Woerdehoff | D06F 58/28 34/486 |
| 2008/0098615 | A1* | 5/2008 | Kim | D06F 58/28 34/493 |
| 2012/0084996 | A1 | 4/2012 | Bellinger et al. | |

FOREIGN PATENT DOCUMENTS

| | | | |
|---|---|---|---|
| CN | 102066648 | A | 5/2011 |
| CN | 102767071 | A | 11/2012 |
| EP | 0863244 | A2 | 9/1998 |
| JP | H09-1997-290095 | A | 11/1997 |
| WO | 2005/012623 | A1 | 2/2005 |

* cited by examiner

CLOTHES DRYER

TECHNICAL FIELD

The present disclosure relates to a clothes dryer capable of lowering the temperature of the clothes during over-drying and reducing the damage to the clothes, regardless of the type and the amount of the clothes.

BACKGROUND

Conventionally, in a known clothes dryer, a drying air heated by a burner is introduced by a fan into a drum into which clothes to be dried are introduced, and the drying air is discharged from a back side of the main body.

FIG. 4 is a flowchart showing processing procedures of a drying operation of a conventional clothes dryer. The clothes dryer process shown in FIG. 4 is generally performed by a control unit, and when a start button is pressed, the operation is started to proceed to step T1.

<Step T1>

In step T1, the control unit starts rotations of the drum and the fan. As a result, the supply of drying air to the drum and the exhaust of drying air from the drum are started.

<Step T2>

In step T2, the control unit ignites the burner. As a result, the supply of high-temperature drying air to the drum is started.

<Step T3>

In step T3, the control unit starts counting the operation time.

<Step T4>

In step T4, the control unit determines whether or not the operation time has reached the end time and determines whether or not to end the operation. If it is determined that the operation is to be ended, the process proceeds to step T10, and if it is determined not to end the operation, the process proceeds to step T5.

<Step T5>

In step T5, the control unit determines whether or not the exhaust temperature has reached an upper limit temperature. If it is determined that the exhaust temperature has reached the upper limit temperature, the process proceeds to step T6. If it is determined that the exhaust temperature has not reached the upper limit temperature, the process returns to step T4.

<Step T6>

In step T6, the control unit stops the burner. As a result, the drying air that is not heated and of substantially normal temperature is supplied to the drum, and hence the interior temperature of the drum is lowered.

<Step T7>

In step T7, the control unit determines whether or not the operation time has reached the end time, and determines whether or not to end the operation. If it is determined that the operation is to be ended, the process proceeds to step T10. If it is determined not to end the operation, the process proceeds to step T8.

<Step T8>

In step T8, the control unit determines whether or not the exhaust temperature has reached a re-ignition temperature. If it is determined that the exhaust temperature has reached the re-ignition temperature, the process proceeds to step T9. If it is determined that the exhaust temperature has not reached the re-ignition temperature, the process returns to step T7.

<Step T9>

In step T9, the control unit re-ignites the burner, and the process proceeds to step T4. As a result, the supply of the high-temperature drying air to the drum is resumed, and the interior temperature of the drum rises again.

<Step T10>

In step T10, the control unit stops the burner, and stops both of the rotation of the fan and the rotation of the drum. As a result, this flow is ended.

As described above, the existing clothes dryer suppresses the abnormal rise of the interior temperature of the drum and prevents the damage to the clothes due to the overheating by repeating the following processes. When the exhaust temperature from the drum reaches the predetermined upper limit temperature, the burner (heat source) is stopped so as to lower the interior temperature of the drum, and thereafter, when the exhaust temperature reaches the predetermined re-ignition temperature, the burner is re-ignited.

However, in the above-described drying operation, even after the exhaust temperature reaches the upper limit temperature, that is, after the moisture contained in the clothes decreases and at least some of the clothes have been almost dried and are excessively dried, the burner is re-ignited at once when the exhaust temperature is lowered to the re-ignition temperature. As a result, the interior temperature of the drum is kept high and the surface temperature of the clothes is kept rising. Such a state leads to a damage of clothes, and the above-described clothes dryer performing the existing drying operation has room for improvement in reducing clothing damages due to overheating.

To solve this problem, the following control may be considered: in the second half of the operation of repeatedly extinguishing/igniting the burner, the upper limit temperature is lowered, and the burner is stopped before the interior temperature of the drum rises excessively. However, the clothes dryer, especially the clothes dryer which the self-service laundry likes to use due to its characteristics, cannot distinguish the type, the weight, etc. of the clothes accommodated in the drum, it is difficult to determine when it is the second half of the operation, so it is difficult to adopt this control.

SUMMARY

An objective of the present disclosure is to effectively solve such a problem and to provide a clothes dryer, which can lower the temperature of clothes in the second half of the operation regardless of the type and the amount of the clothes, and can uniformly dry all the clothes while sufficiently reducing the damage of the clothes caused by overheating.

In view of the above-mentioned problem, the present disclosure adopts the following technical solution.

The clothes dryer of the present disclosure includes a drum capable of accommodating clothes; an air supply/exhaust unit for supplying drying air to the drum and exhausting drying air from the drum; a heating unit for heating the drying air supplied to the drum; an exhaust temperature detection unit for detecting a temperature of the drying air exhausted from the drum; and a heating control unit for performing a temperature adjustment process of stopping the heating unit when an exhaust temperature detected by the exhaust temperature detection unit reaches a predetermined upper limit temperature and restarting the heating unit after a time point when the exhaust temperature decreases to a predetermined lower limit temperature. The heating control unit has a delay time inserting portion. The delay time inserting portion inserts a delay time between the time point when the exhaust temperature decreases to the predetermined lower limit temperature and a time when the heating unit is restarted, and the delay time is increased every time the temperature adjustment process is repeated intermittently.

In particular, it is preferable that the delay time is determined by adding a predetermined additional time to an immediately previous delay time.

Further preferably, an upper limit value is set for the delay time, and when the delay time reaches the upper limit value as the temperature adjustment process is repeated, a subsequent temperature adjustment process is performed with the delay time.

In addition, preferably, the heating unit is a non-adjustable burner having no heating power adjustment function.

According to the present disclosure described above, the drying air heated by the heating unit is supplied into the drum by the air supply/exhaust unit to dry the clothes, and the time point when the exhaust temperature detected by the exhaust temperature detection unit reaches the upper limit temperature is set to be a substantial boundary between the first half and the second half of the drying operation. The time point when the exhaust temperature reaches the upper limit temperature is not taken as a benchmark, while instead, the time point when the exhaust temperature has decreased to the lower limit temperature is taken as a re-ignition benchmark for the restarting of heating unit. Thus, the temperature adjustment process can be performed by the heating control unit in the second half of the drying operation without strictly estimating the type and amount of the clothes. In this temperature adjustment process, by the delay time inserting portion, the delay time which is gradually extended every time the temperature adjustment process is repeated intermittently is inserted. Therefore, drying of the clothes can be continued by the drying air which is not heated, and the temperature inside the drum can be lowered to a temperature lower than the temperature in the previous temperature adjustment process. Therefore, regardless of the type and the amount of the clothes to be dried, the peak temperature inside the drum in each temperature adjustment process is gradually lowered at the second half of the drying operation, thereby gently lowering the temperature of the clothes in the over-drying state, and uniformly drying all the clothes L while sufficiently reducing the damage to the clothes caused by overheating.

In particular, according to the present disclosure in which the delay time is determined by adding a predetermined additional time to an immediately previous delay time, it is easy to implement the control of evenly drying the whole clothes L while sufficiently reducing the damage of clothes L caused by overheating.

Furthermore, according to the present disclosure in which the upper limit value is set for the delay time, the temperature of the clothes is prevented from decreasing excessively in the second half of the drying operation and the desired drying performance is ensured without causing insufficient drying.

In addition, according to the present disclosure in which the heating unit is a non-adjustable burner having no heating power adjustment function, the manufacturing costs can be reduced as compared with the case of using the adjustable burner.

Figure 1:
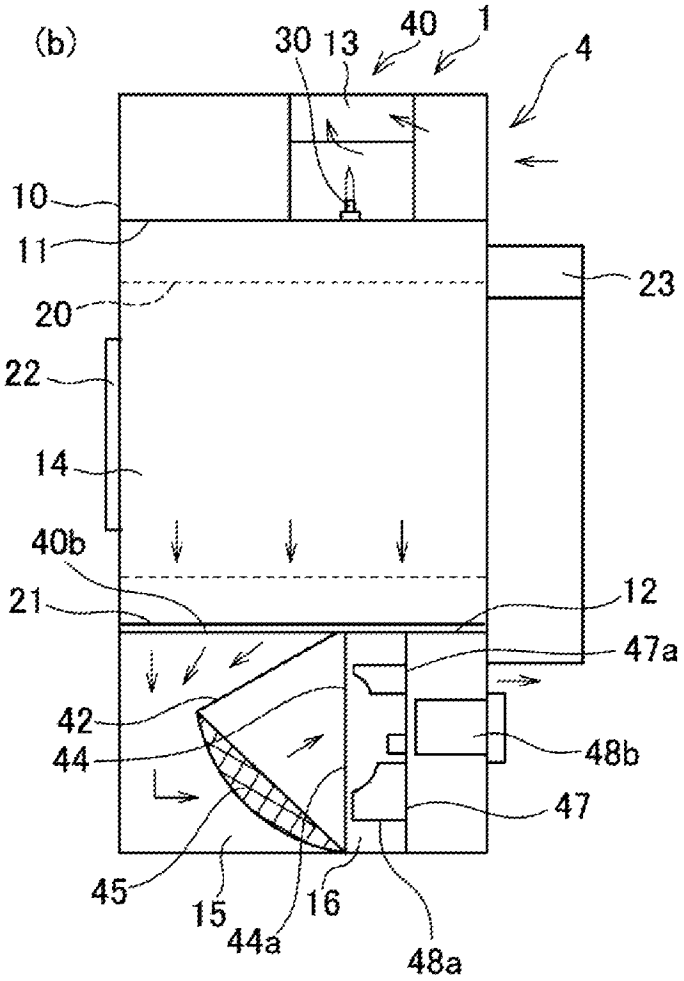
FIG. 1 are schematic views showing a clothes dryer according to an embodiment of the present invention.
Figure 1:
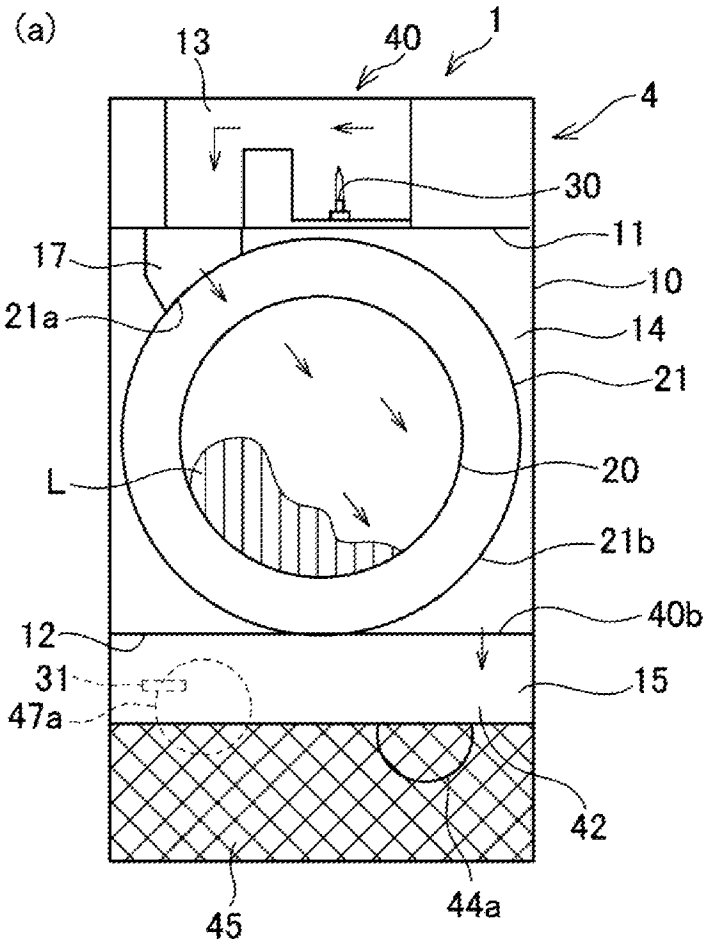

A list of reference numerals:

1: Clothes dryer; 4. Air supply/exhaust unit; 20: Drum; 30: Burner (heating unit); 31: Temperature sensor (exhaust temperature detection unit); 55: heating control unit; 56: Delay time inserting portion; A: Additional time; L: Clothes; N: Re-ignition delay time (delay time)

DETAILED DESCRIPTION

Hereinafter, an embodiment of the present disclosure will be described in detail with reference to the accompanying drawings.

Figure 2:
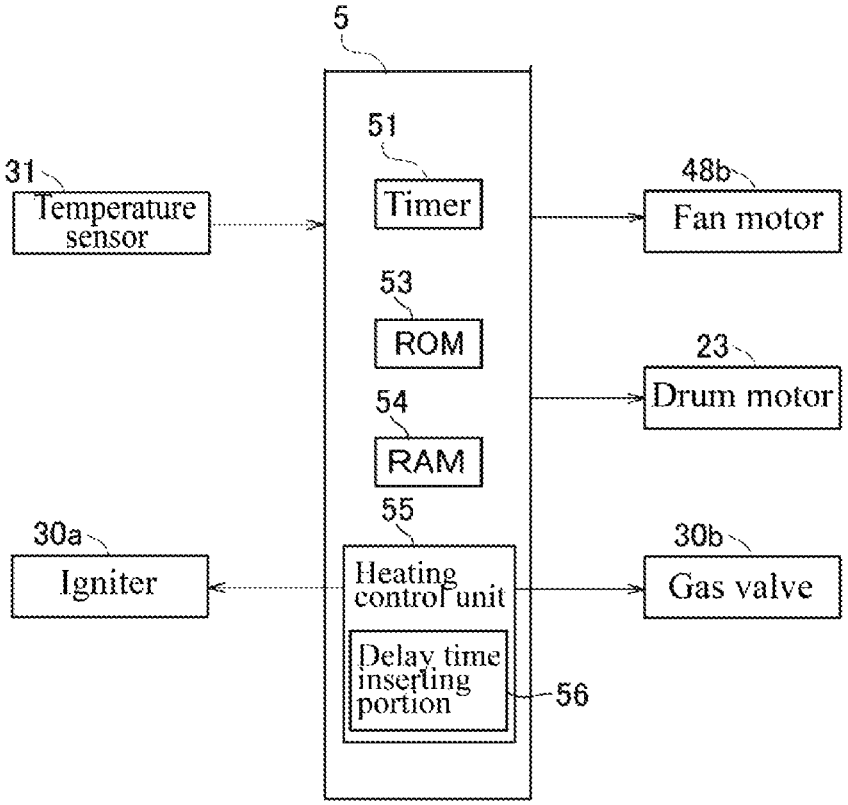
FIG. 2 is a block diagram showing a structure of the same clothes dryer.

FIG. 1 are schematic views showing a clothes dryer 1 according to an embodiment of the present disclosure. FIG. 1A is a front view of the clothes dryer 1, and FIG. 1B is a side view of the clothes dryer 1. FIG. 2 is a block diagram showing a structure of the clothes dryer 1.

The clothes dryer 1 of the present embodiment includes an apparatus main body 10, a drum 20 and a drum case 21, a drum motor 23, a burner 30, an air supply/exhaust unit 4, a temperature sensor (thermistor) 31, and a control unit 5 (see FIG. 2). The clothes dryer 1 is particularly used in a self-service laundry.

The interior of the apparatus main body 10 is isolated by an upper partition plate 11 and a lower partition plate 12. A combustion chamber 13 is formed at the upper portion of the interior of the apparatus main body 10, a drying chamber 14 is formed at the middle portion of the interior of the apparatus main body 10, and an air passage chamber 15 and a fan motor chamber 16 are formed at the lower portion of the interior of the apparatus main body 10.

The drum 20 is provided in the cylindrical drum case 21 in the drying chamber 14, and is arranged concentrically with the drum case 21 with an axis being a front-rear direction of a main body of the dryer main 1. Further, the drum 20 has a diameter smaller than that of the drum case 21 and has a large number of small holes (not shown) on its circumferential surface. The drum 20 can repeatedly rotate forwardly and rotate reversely for unwinding the clothes. Such a drum 20 can accommodate the clothes L to be dried.

An intake port 21*a* (see FIG. 1A) is formed at the upper left position of the drum case 21, and the intake port 21*a* is communicated with the combustion chamber 13 to be described below via a short ventilation duct 17. An exhaust port 21*b* (see FIG. 1A) is formed at the lower right position of the drum case 21. A front opening of the drum 20 can be tightly closed by a door 22, such that the front opening can be freely opened and closed.

The drum motor 23 is mounted on the upper portion of the rear surface of the apparatus main body 10, and the drum 20 is driven to rotate by a rotational force of the drum motor 23.

The burner 30 as a heating unit is provided in the combustion chamber 13 and heats the drying air supplied into the drum 20 through the small holes. Further, the burner 30 is a non-adjustable type having no heating power adjustment function. Gas is supplied to or occluded from the burner 30 by a gas valve 30*b* shown in FIG. 2. In addition, an igniter 30*a* (see FIG. 2) is provided in the vicinity of the burner 30.

The air supply/exhaust unit 4 supplies the drying air to the drum 20 and exhausts the drying air from the drum 20, and includes a supply/exhaust passage 40, an exhaust fan 48*a* and a fan motor 48*b*.

The supply/exhaust passage 40 is constituted by the combustion chamber 13, the ventilation duct 17, the drum case 21, a ventilation port 40*b* formed in the lower partition plate 12 facing the exhaust port 21*b*, the ventilation chamber 15 and the fan motor chamber 16.

The ventilation chamber 15 is formed below the lower partition plate 12 and isolated from the fan motor chamber 16 by a partition plate 44 arranged substantially vertically. Further, an air filter 45 is disposed across a lower end portion of a shielding plate 42 whose upper end portion is fixed to the lower partition plate 12 and a lower end portion of the partition plate 44, and a vent hole 44*a* (see FIG. 1A) is formed at the right position of the partition plate 44.

The fan motor chamber 16 is provided with an exhaust fan 48*a* at the front surface of the fan partition plate 47 and a fan motor 48*b* provided at the rear surface of the fan partition plate 47 for causing the exhaust fan 48*a* to rotate. An exhaust opening 47*a* (see FIG. 1A) is formed at the upper left portion of the fan partition plate 47.

The temperature sensor 31 as an exhaust temperature detection unit detects the temperature (exhaust temperature) of the drying air exhausted from the drum 20, and is provided in the vicinity of the exhaust fan 48*a*, that is, at the exhaust opening 47*a* of the fan partition plate 47. It is difficult to measure the interior temperature of the drum 20 in real time during the operation, but by using the temperature sensor 31, the interior temperature of the drum 20 is indirectly measured in real time.

The operation of such a clothes dryer 1 is controlled by the control unit 5 (see FIG. 2) including a microcomputer. The control unit 5 includes a heating control unit 55, a timer 51, a ROM 53 and a RAM 54. By executing a program (such as a temperature adjustment process to be described below) stored in the ROM 53 by a microcomputer, a predetermined operation is performed. The data (such as a re-ignition delay time to be described below) to be used for executing the above program is temporarily stored in the RAM 54.

The control unit 5 can output a fan motor drive signal to the fan motor 48*b* and can output a drum motor drive signal to the drum motor 23.

The heating control unit 55 can output an ignition signal to the igniter 30*a* and output a gas supply signal to the gas valve 30*b*.

Further, the heating control unit 55 performs the following temperature adjustment process. When the exhaust temperature detected by the temperature sensor 31 reaches a predetermined upper limit temperature, the heating control unit 55 stops the burner 30, and after the exhaust temperature drops to the predetermined lower limit temperature (i.e. after the time point of the re-ignition temperature), the burner 30 is operated again. In the present embodiment, for example, the upper limit temperature is set to be about 70° C., and the re-ignition temperature is set to be about 40 to 45° C. in advance.

Furthermore, the heating control unit 55 has a time-delay inserting portion 56, which inserts a re-ignition delay time, as a delay time, between a time point, when the exhaust temperature decreases to the re-ignition temperature, and a time point, when the burner 30 is restarted. The re-ignition delay time is gradually extended every time the temperature adjustment process is repeated intermittently.

Thus, the clothes dryer 1 in this embodiment includes a drum 20 capable of accommodating clothes L, an air supply/exhaust unit 4 for supplying drying air to and exhausting drying air from the drum 20, a burner 30 as a heating unit for heating the drying air supplied to the drum 20, a temperature sensor 31 as an exhaust temperature detection unit for detecting the temperature of the drying air exhausted from the drum 20, and a heating control unit 55. The heating control unit 55 performs the following temperature adjustment process: stopping the burner 30 when the exhaust temperature that is detected by the temperature sensor 31 reaches an upper limit temperature and restarting the burner 30 after the exhaust temperature decreases to a time point of the re-ignition temperature which is the predetermined lower limit temperature. The heating control unit 55 has a time-delay inserting portion 56. The delay time inserting portion 56 inserts a re-ignition delay time N, as a delay time, between a time point, at which the exhaust temperature decreases to the re-ignition temperature, and a time point, at which the burner 30 is restarted temperature adjustment process. The re-ignition delay time N is gradually extended every time the temperature adjustment process is repeated intermittently.

With such a configuration, the drying air heated by the burner 30 is supplied to the drum 20 by the air supply/exhaust unit 4 to dry the clothes L, and the time point at which the exhaust temperature reaches the upper limit temperature is set to be a substantial boundary between the first half and the second half of the drying operation. The time point when the exhaust temperature reaches the upper limit temperature is not taken as a benchmark, and instead, the time point when the exhaust temperature has decreased to the re-ignition temperature is taken as a re-ignition benchmark for the burner 30. Thus, the temperature adjustment process can be performed by the heating control unit 55 in the second half of the drying operation without strictly estimating the type and weight of the clothes L introduced into the drum 20. In the temperature adjustment process, by the delay time inserting portion 55, the re-ignition delay time N which is gradually extended every time the temperature adjustment process is repeated intermittently is inserted. Therefore, drying of the clothes L can be continued by the drying air which is not heated, and the temperature inside the drum 20 can be lowered to a temperature lower than the temperature in the previous temperature adjustment process. Therefore, regardless of the type and the amount of the clothes L to be dried, the peak temperature inside the drum 20 in each temperature adjustment process is gradually lowered at the second half of the drying operation, thereby gently lowering the temperature of the clothes L in the over-drying state. Compared with the existing continuous high temperature operation, all the clothes L can be uniformly dried while sufficiently reducing the damage to the clothes L caused by overheating.

Furthermore, when such an effect is exerted, new sensors are unnecessary, and it is possible to use the current mechanical structure without increasing the costs.

It should be noted that, as another method for lowering the temperature of the clothes with reaching the upper limit temperature as the threshold, it is conceivable to lower the upper limit temperature itself from the time when the exhaust temperature reaches the upper limit temperature. However, in this method, since the time when the exhaust temperature reaches the upper limit temperature again after the re-ignition of the burner 30 is advanced, the number of times of ignition and extinction of the burner 30 increases throughout the entire operation, which is disadvantageous in terms of the durability of the machine.

In the present disclosure, the number of times of ignition and extinction of the burner 30 decreases as compared with the above method, which is advantageous also from the aspect of durability of the machine.

In addition, as described above, when the exhaust temperature reaches the upper limit temperature for the first time, the surface of the clothes L is in a substantially dried state. Compared with the wet portions, dried portions are more easily damaged by heat. This point is not taken into account in the prior arts. In addition, no mention is made of the idea that the re-ignition delay time N is inserted when an undried portion possibly remains so that the temperature inside the drum 20 is lowered.

Figure 3:
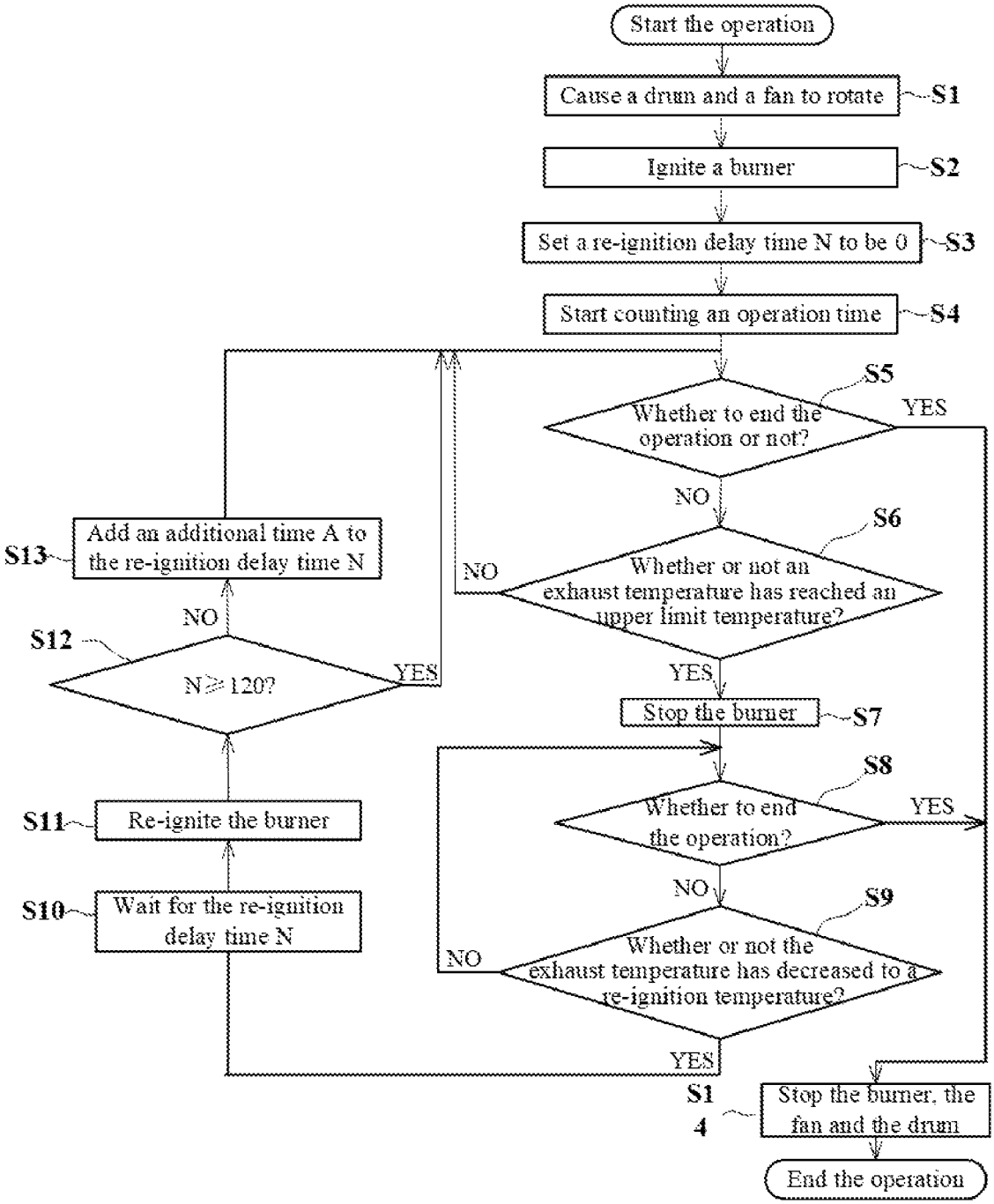
FIG. 3 is a flowchart showing a processing sequence of a drying operation of the same clothes dryer.

FIG. 3 is a flowchart showing the processing sequences of the drying operation of the clothes dryer 1. Hereinafter, the processing sequences of the drying operation will be specifically described with reference to FIG. 3.

The clothes L to be dried are thrown into the drum 20 by opening the door 22, and after the door 22 is closed, a start button (not shown) is pressed, thereby starting the flows.

<Step S1>

In step S1, the control unit 5 outputs the drum motor drive signal to the drum motor 23 to start the rotation of the drum 20, and outputs the fan motor drive signal to the fan motor 48*b* to start the rotation of the exhaust fan 48*a*. As a result, the air in the fan motor chamber 16 is discharged to the outside of the apparatus, and the air flows from the combustion chamber 13, towards the fan motor chamber 16, to the supply/exhaust passage 40, and the supply and the exhaust of the drying air to and from the drum 20 is started.

<Step S2>

In step S2, the heating control unit 55 outputs a gas supply signal to the gas valve 30*b* to turn on the gas valve 30*b*, and also outputs an ignition signal to the igniter 30*a* to ignite the burner 30. As a result, a supply of high-temperature drying air to the drum 20 is started.

<Step S3>

In step S3, the control unit 5 sets the re-ignition delay time N to be 0 (second).

<Step S4>

In step S4, the control unit 5 causes the timer 51 to start counting the operation time.

<Step S5>

In step S5, the control unit 5 determines whether or not the operation time has reached the end time based on the count value of the timer 51, and determines whether or not to end the operation. If it is determined that the operation is to be ended, the process proceeds to step S14. If it is determined not to end the operation, the process proceeds to step S6.

<Step S6>

In step S6, the control unit 5 determines whether or not the exhaust temperature detected by the temperature sensor 31 has reached the upper limit temperature. When it is determined that the exhaust temperature has reached the upper limit temperature, the process proceeds to step S7, and when it is determined that the exhaust temperature has not reached the upper limit temperature, the process returns to step S5. It should be noted that, if the amount of water in the drum 20 is large, even if the high-temperature drying air is supplied, the heat is utilized for the evaporation of water, and the temperature inside the drum 20 is hard to rise. The more the amount of the clothes and the moisture contained by the clothes are, the more time it takes for the exhaust temperature to reach the upper limit temperature. In addition, since differences exist due to different fabrics and amounts of clothes L, the interior of the clothes L is often still wet when the exhaust temperature reaches the upper limit temperature for the first time, even if the surface of the clothes L is dried.

<Step S7>

In step S7, the heating control unit 55 stops the gas supply to the burner 30 by the gas valve 30*b* and stops (extinguishes) the burner 30.

<Step S8>

In step S8, based on the count value of the timer 51, the control unit 5 determines whether or not the operation time has reached the end time, and determines whether or not to end the operation. If it is determined that the operation is to be ended, the process proceeds to step S14, and if it is determined not to end the operation, the process proceeds to step S9.

<Step S9>

In step S9, the control unit 5 determines whether or not the exhaust temperature detected by the temperature sensor 31 has decreased to the re-ignition temperature. If it is determined that the exhaust temperature has decreased to the re-ignition temperature, the process proceeds to step S10, and when it is determined that the exhaust temperature has not decreased to the re-ignition temperature, the process returns to step S8.

<Step S10>

In step S10, the time-delay inserting portion 56 makes the output of the gas supply signal and the ignition signal delay for the re-ignition delay time N.

<Step S11>

In step S11, the heating control unit 55 outputs the gas supply signal to the gas valve 30*b* and outputs the ignition signal to the igniter 30*a* to re-ignite the burner 30.

<Step S12>

In step S12, the control unit 5 determines whether or not the re-ignition delay time N is equal to or greater than 120 (seconds). If it is determined that the re-ignition delay time N is equal to or greater than 120 (seconds), the process proceeds to step S5, and if it is determined that the re-ignition delay time N is not equal to or greater than 120 (seconds), the process proceeds to step S13.

Here, 120 (second) is the upper limit value of the re-ignition delay time N. As described above, the upper limit value is provided for the re-ignition delay time N. When the temperature adjustment process is repeated and the re-ignition delay time N reaches the upper limit value, the subsequent temperature adjustment process is performed with this re-ignition delay time N. Therefore, the temperature of the clothes is prevented from being excessively lowered so as to ensure the desired drying performance without insufficient drying. It should be noted that, the upper limit value of the re-ignition delay time N is not limited to 120 seconds as long as the effect of the present disclosure can be exhibited.

<Step S13>

In step S13, the control unit 5 adds 5 (second) as the additional time A to the re-ignition delay time N. In this way, the re-ignition delay time N is added by the additional time every time the temperature adjustment process is performed until the re-ignition delay time N reaches the upper limit value. As described above, the re-ignition delay time N is determined by adding the predetermined additional time A to the previous re-ignition delay time N, therefore, the above control of evenly drying the whole clothes L while sufficiently reducing the damage of clothes L caused by overheating can be easily implemented. Further, the additional time A is set to be about 5 seconds, such that the peak temperature in the drum 20 in each temperature adjustment process can be reduced by an appropriate temperature difference considering the reduction of the damage of the clothing L and the drying to the undried portion in the second half of the operation. Furthermore, even if the time point when the exhaust temperature reaches the upper limit deviates from the boundary of the first half and the second half of the actual drying operation, since the re-ignition delay time N is accumulated step by step, the peak temperature in the drum 20 for each temperature adjustment process gradually decreases, which does not have a large influence on the drying performance.

<Step S14>

In step S14, the heating control unit 55 stops the burner 30, and the control unit 5 stops the rotation of the exhaust fan 48*a* and the drum 20, respectively, thereby terminating the present flow.

Figure 4:
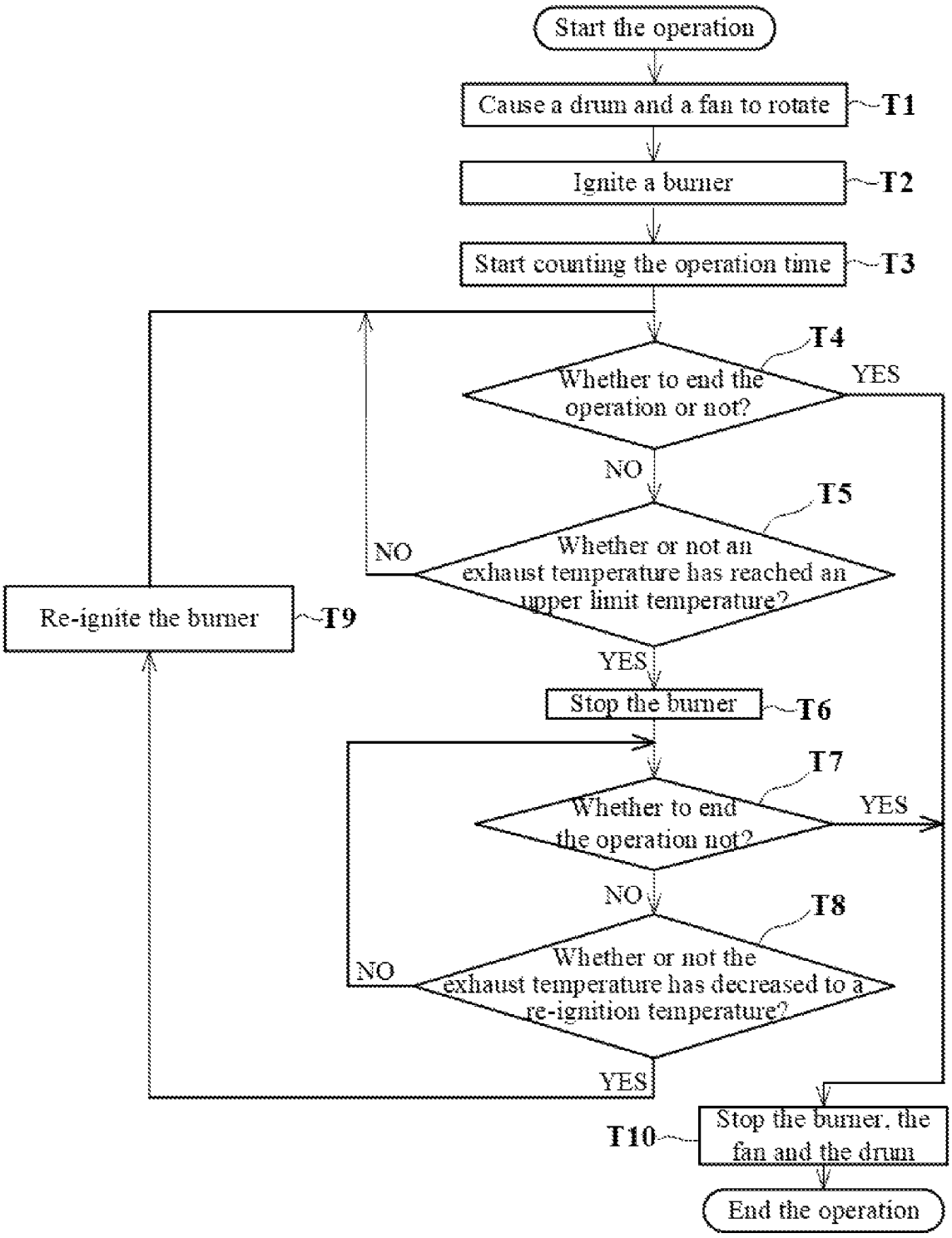
FIG. 4 is a flowchart showing a processing sequence of a drying operation of an existing clothes dryer.

As described above, the clothes dryer 1 in the present embodiment has an operation mode of reducing the damage to the clothing by lowering the temperature of the clothes when the clothes L are excessively dried. It should be noted that, in an experiment conducted with the clothes dryer 1 set with the upper limit temperature of about 70° C., the re-ignition temperature of about 40 to 45° C., and the additional time A of 5 seconds, the peak temperature in the drum 20 during the drying operation can be reduced by about 10° C. as compared with the existing drying operation shown in FIG. 4. The experiment data is obtained by the Thermo Label (registered trademark) capable of measuring the highest temperature in the drum 20.

It should be noted that, as another method for lowering the temperature of the clothes during over-drying, a heating power adjustment type burner capable of adjusting the heating power in a plurality of stages is used. After the exhaust temperature reaches the upper limit temperature, the burner's heating power is adjusted to a small value so that the temperature of the clothes decreases.

In this case, the number of ignition/extinguishing times can be suppressed to a small number as the heating power of the burner is adjusted. There are few problems with the machine durability, but the use of adjustable burner results in increased equipment manufacturing costs. The present invention adjusts the temperature inside the drum by the insertion of the re-ignition delay time N, and the heating unit only needs to be turned ON/OFF, therefore, the non-adjusted type burner 30 can be used as the heating unit, which is particularly advantageous in terms of the manufacturing costs.

Although the embodiment of the present disclosure has been described above, the specific configuration of each portion is not limited only to the above-described embodiment.

For example, in the present embodiment, the burner 30 is used as the heating unit, but other devices may be used as long as the drying air can be heated.

In the present embodiment, the re-ignition delay time N in the next temperature adjustment process is determined by adding the additional time A to the re-ignition delay time N, but it is not limited to this. The re-ignition delay time N in the next temperature adjustment process may be determined by adding a predetermined variable to the re-ignition delay time N, or by multiplying the re-ignition delay time N by a predetermined variable. In addition, the re-ignition delay time N may be determined based on a table in which the number of repetitions of the temperature adjustment processes and the re-ignition delay time N are associated.

Other structures can be modified in various ways without departing from the spirit of the present disclosure.

What is claimed is:

1. A clothes dryer, comprising:

a drum capable of accommodating clothes;

an air supply/exhaust unit for supplying/exhausting drying air to/from the drum;

a heating unit for heating the drying air supplied to the drum;

an exhaust temperature detection unit for detecting a temperature of the drying air exhausted from the drum; and a heating control unit for performing a temperature adjustment process of stopping the heating unit when the temperature of the drying air exhausted from the drum reaches a predetermined upper limit temperature and restarting the heating unit after a time point when the temperature of the drying air exhausted from the drum decreases to a predetermined lower limit temperature, wherein the heating control unit has a delay time inserting portion, the delay time inserting portion inserts a delay time between the time point when the temperature of the drying air exhausted from the drum decreases to the predetermined lower limit temperature and a time when the heating unit is restarted, and the delay time is increased each time the temperature adjustment process is intermittently repeated.

2. The clothes dryer according to claim 1, wherein the delay time is determined by adding a predetermined additional time to an immediately previous delay time.

3. The clothes dryer according to claim 2, wherein an upper limit value is set for the delay time, and when the delay time reaches the upper limit value as the temperature adjustment process is repeated, a subsequent temperature adjustment process is performed with the delay time.

4. The clothes dryer according to claim 1, wherein the heating unit is a non-adjustable burner having no heating power adjustment function.

5. The clothes dryer according to claim 2, wherein the heating unit is a non-adjustable burner having no heating power adjustment function.

6. The clothes dryer according to claim 3, wherein the heating unit is a non-adjustable burner having no heating power adjustment function.

* * * * *